United States Patent [19]

Hampton

[11] Patent Number: 4,537,533

[45] Date of Patent: Aug. 27, 1985

[54] INSTALLATION AND LEVELLING OF SUBSEA TEMPLATES

[75] Inventor: James E. Hampton, Peterculter, Scotland

[73] Assignee: Sedco, Inc., Dallas, Tex.

[21] Appl. No.: 450,992

[22] Filed: Dec. 21, 1982

Related U.S. Application Data

[63] Continuation-in-part of Ser. No. 292,014, Aug. 11, 1981, Pat. No. 4,435,108.

[30] Foreign Application Priority Data

Jan. 28, 1981 [GB] United Kingdom ..... 8102548
Jan. 28, 1982 [GB] United Kingdom ..... 8202491

[51] Int. Cl.[3] ..... E02B 17/02

[52] U.S. Cl. ..... 405/227; 405/205; 405/224

[58] Field of Search ..... 405/195, 196, 199, 203, 405/205, 224, 227, 228; 175/5, 7

[56] References Cited

U.S. PATENT DOCUMENTS 3,378,086 4/1968 Kivisild ..... 405/224 X
3,841,607 10/1974 Larralde et al. ..... 175/5 X
3,987,638 10/1976 Burkhardt et al. ..... 405/203
4,405,261 9/1983 Lawson ..... 405/227
4,408,932 10/1983 Cowan ..... 405/227
4,435,108 3/1984 Hampton ..... 405/209

FOREIGN PATENT DOCUMENTS 2009815 6/1979 United Kingdom .
2026577 2/1980 United Kingdom .
2054710 2/1981 United Kingdom .

*Primary Examiner*—David H. Corbin
*Attorney, Agent, or Firm*—Hubbard, Thurman, Turner & Tucker

[57] ABSTRACT

Subsea drilling and foundation templates are lowered from a semi-submersible drill rig and levelled utilizing the drill string hoisting apparatus including a heave compensator suspended from the travelling block of the hoisting apparatus, a riser string suspensed from the heave compensator and connected to the template at substantially its center of gravity and further including a constant tension rotary drum air powered hoist supported on the riser string below the heave compensator and having a tension cable secured to a fixed reference point on the seabed such as one of the template supporting piles. The tension on the cable may be selectively adjusted to dampen the motion of the riser string during levelling procedure so that the position of the template with respect to its supporting piles may be referenced and the template secured to the piles when a level condition is reached.

11 Claims, 13 Drawing Figures

INSTALLATION AND LEVELLING OF SUBSEA TEMPLATES

CROSS REFERENCE TO RELATED APPLICATION

This application is a continuation-in-part of prior copending application Ser. No. 292,014, filed Aug. 11, 1981, now U.S. Pat. No. 4,435,108.

BACKGROUND OF THE INVENTION

1. Field of the Invention

The present invention pertains to a method and apparatus for installing and levelling subsea drilling and/or foundation templates and the like using a semi-submersible drilling rig equipped with a heave compensator.

2. Background

In the art of developing subsea installations for production of hydrocarbons from formations below the seabed there have been numerous types of installations placed on the seabed including structures known as templates and the like. These structures are typically characterized by large skeletal frames which are used for supporting wellhead components and other apparatus used in conjunction with drilling and producing hydrocarbons from subsea wells.

There are several problems associated with handling the relatively large structures known as templates. The process of loading, transporting and installing a subsea template using a semi-submersible drilling rig or other floating structure has presented several problems in the overall procedure of handling the templates from the point of embarkation to the final installation and levelling procedure.

In particular, it is difficult to properly position or level a subsea template from a floating structure unless sea conditions are totally calm, a rare occurrence in many offshore oil fields, particularly areas such as the North Sea. The levelling procedure is, however, desirable and necessary in order that the template or other related structure be properly oriented with respect to a floating drill rig, for example, which will be working through and utilizing the template. Moreover, a levelling procedure using a floating vessel such as a semi-submersible drilling rig, which may be constantly changing its elevation with respect to the seabed as a result of sea conditions, has presented several problems in the art of installing subsea templates. However, the present invention provides an improved method and apparatus for installing and properly levelling a subsea template or the like using a floating drilling rig or a similar floating vessel equipped with hoisting apparatus. In particular, the present invention pertains to an improved method and apparatus using a semi-submersible floating drilling rig equipped with a heave compensator or the like.

SUMMARY OF THE INVENTION

The present invention pertains to an improved method for loading, installing, and final levelling of a subsea template using a floating drilling rig or the like. In accordance with one aspect of the present invention there is provided a method for levelling a subsea template using a semi-submersible drilling rig which is equipped with a motion or heave compensator connected with a drill string or riser supporting and hoisting apparatus which is used for final positioning and levelling of the template on the seabed.

In accordance with another aspect of the present invention there is provided an improved apparatus for installing and final levelling of a subsea template utilizing a drilling derrick, hoisting apparatus associated with the derrick and a heave compensator interposed in the hoisting apparatus for compensating for the motion of the load suspended from the drilling rig. The apparatus provides for suspending and levelling a subsea template using a supporting structure which supports the template above its center of gravity and includes apparatus for dampening the motion of the template with respect to the seabed during the final levelling process. In particular, the apparatus for final levelling of the template includes an arrangement whereby the template is suspended from a riser string connected at its upper end to a heave compensator associated with the drill rig hoisting apparatus and wherein an auxiliary hoist suspended from the heave compensator and connected to the riser string includes a winch connected to a cable which is connected at its lower end to a fixed point on the seabed such as an anchor pile for the template, said cable having a preselected constant tension applied thereto by the winch to dampen any oscillating motion of the template during the final levelling process.

In accordance with yet a further aspect of the present invention there is provided a process for final levelling of a subsea template utilizing a drilling rig hoisting apparatus including a heave compensator, a motion dampening winch and cable arrangement suspended from the heave compensator and wherein the template is provided with a plurality of pile slip assemblies which may be actuated once the template is levelled to secure the template in a levelled position and supported by a plurality of piles driven or drilled into the seabed.

In accordance with another aspect of the present invention there is provided an improved method utilizing a semi-submersible column stabilized drilling rig for transporting and installing a subsea template in a predetermined position on the seafloor.

Those skilled in the art will appreciate the above described features of the present invention as well as other superior aspects thereof upon reading the detailed description which follows in conjunction with the drawings.

DESCRIPTION OF THE PREFERRED EMBODIMENTS

Figure 1:
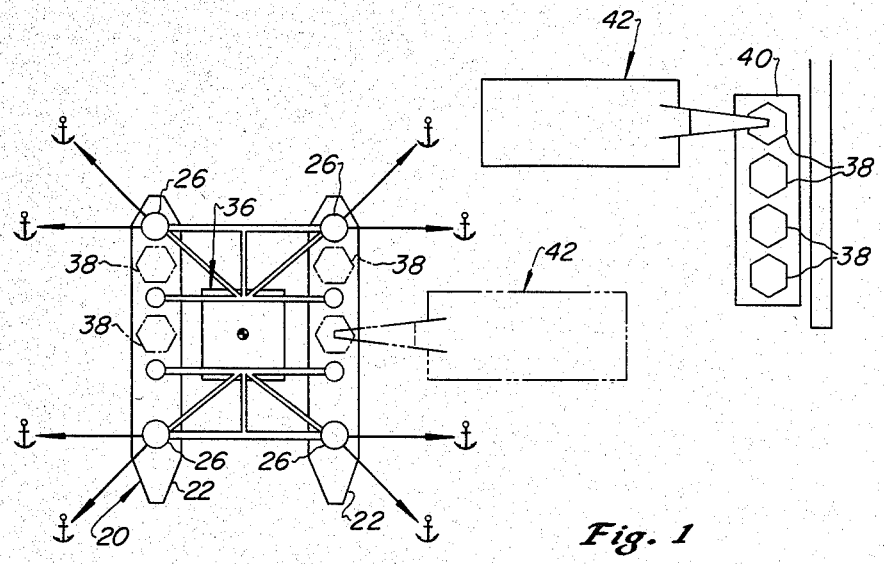
FIG. 1 is a plan view illustrating a template being loaded on to a semi-submersible column stabilized drilling rig with its main deck structure removed.

In the description which follows like parts are marked throughout the specification and drawings with the same reference numerals, respectively. The drawings are not necessarily to scale and certain features of the invention may be exaggerated in scale or shown in schematic form in the interest of clarity and conciseness.

Figure 2:
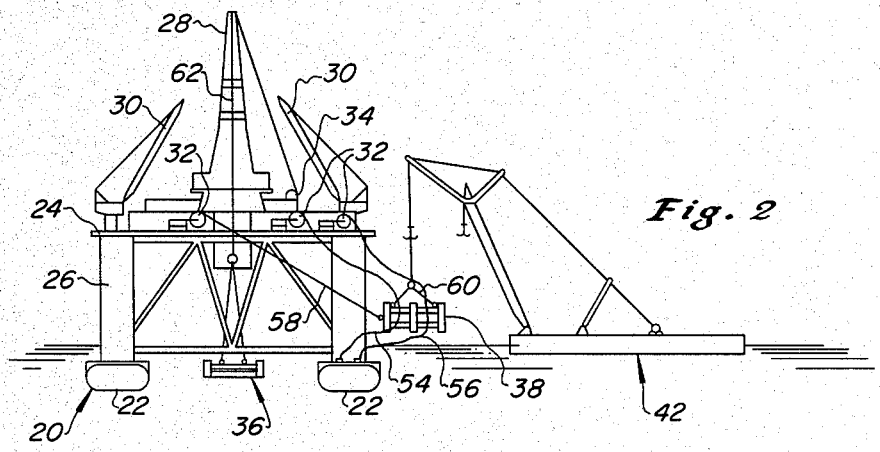
FIG. 2 is a side elevation illustrating an intermediate step in loading the template on the drilling rig.
Figure 3:
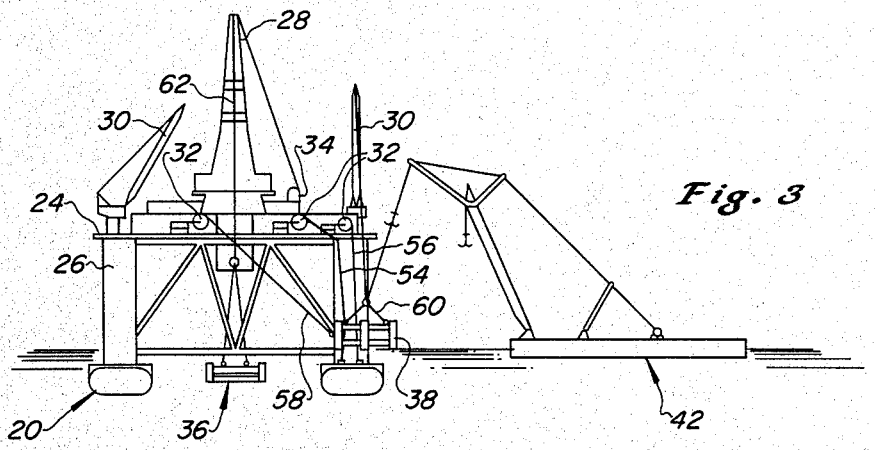
FIG. 3 is a view similar to FIG. 2 showing the template being set on a hull of the drilling rig.

Referring to FIGS. 1 through 3 there is illustrated a floating drilling rig of the type known in the art as a column stabilized semi-submersible rig and which is generally designated by the numeral 20. The rig 20 is of the variable draft type and comprises spaced apart longitudinal submersible hulls 22 which are interconnected by a suitable framework including a main deck structure 24 and spaced apart vertical corner columns 26. The rig 20 is adapted to include a drilling derrick 28, one or more deck mounted boom cranes 30 and a plurality of deck mounted powered drum type winches 32. The rig 20 is also adapted to include conventional drilling rig hoisting and drill stem rotating apparatus which will be described in further detail herein. The hoisting apparatus may include a suitable drawworks, generally designated by the numeral 34 in FIGS. 2 and 3. In the views of FIGS. 1 through 3 the drilling rig 20 has previously been positioned over a template 36 and has loaded the template to be suspended from the derrick 28 by the aforementioned hoisting apparatus and between the spaced apart hulls 22. The template 36 is a skeletal frame type structure which will be described in some further detail herein in conjunction with FIG. 8. The procedure of loading and securing the template 36 is described in the above referenced copending application which is assigned to the assignee of the present invention.

Figure 5:
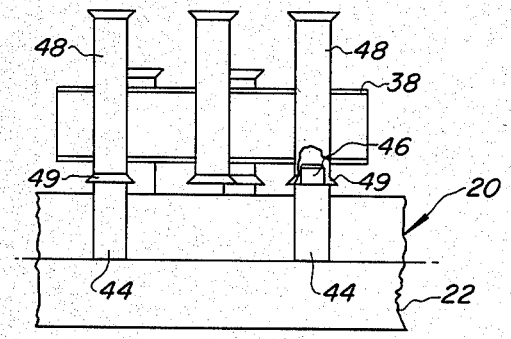
FIG. 5 is a view taken along the line 5—5 of FIG. 4.
Figure 6:
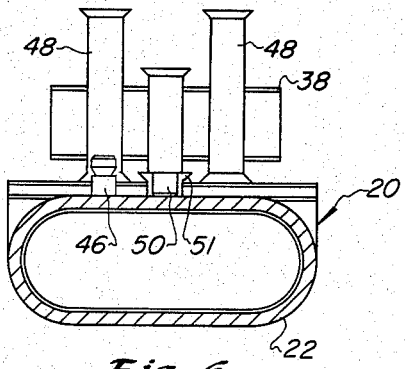
FIG. 6 is a section view taken along the lines 6—6 of FIG. 4.

Referring further to FIGS. 1 through 3 there is illustrated a procedure for loading additional templates, each designated by the numeral 38, which may be, for example, foundation tempates for a tension leg platform or may comprise further drilling templates or other suitable support structures to be deposited on and secured to the seabed. As shown in FIG. 1, with the rig 20 suitably anchored in a calm harbor or other anchorage, the templates 38 are loaded on to the rig by transferring the templates from a barge 40 utilizing a floating crane 42. Referring briefly to FIGS. 5 and 6 the hulls 22 of the drilling rig are provided with support frames 44 on which are mounted spaced apart pinlike stab guides 46 which are adapted to receive in locating and supporting relationship spaced apart pile sleeves 48 forming part of the framework of the templates 38. Each of the guide sleeves 48 is provided with a downwardly facing cone portion 49 to facilitate location and interengagement of the stab guides with the respective sleeves. The templates 38 may also be provided with preinstalled stab guides 50, FIG. 6, locatable in stab receiving cones 51 welded to the framework 44.

FIG. 2 illustrates the floating crane 42 in position for loading a template 38 on to one of the support frames on a hull 22 using a sling 60 as indicated. The template 38 is preferably provided with suitable fair leads, not shown, through which guide cables 54 and 56 are run from respective ones of the winches 32 to the support frame 44. A third one of the winches 32 includes a tugger line 58 secured to the template 38 to aid in positioning the template over the support frame 44. As shown in FIG. 3 the starboard side deck crane 30 is also brought into operation by being connected to the template 38 during the final positioning process on the hull 22. The templates 38 are of a type which include buoyant hull structures which may be floodable to control the buoyancy of the templates, respectively. Accordingly, the hulls 22 may be submerged to a point wherein as each of the templates 38 is lowered into position on its associated support framing 44 the template is submerged to a floating position. At this point a suitable ballast control line is connected to the template and the template is ballasted until it is securely disposed on the frame 44 and until a certain amount of negative buoyancy is obtained. This may be measured by suitable weight indicator apparatus associated with the starboard deck crane 30.

Figure 4:
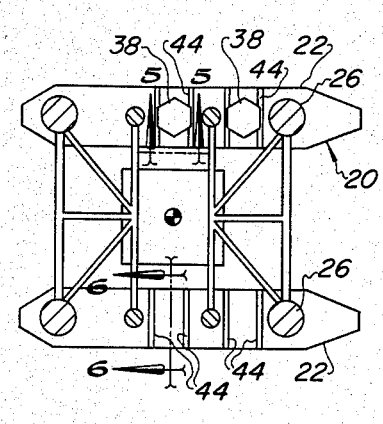
FIG. 4 is a cutaway plan view of the semi-submersible drilling rig showing the location of several templates in their loaded positions.

After each respective one of the templates 38 are located in position on the associated hulls 22 the sling 60 associated with each template is left with the template for use by the rig hoisting apparatus to remove the template for installation at the preferred site. Each template 38 is loaded out from the barge 40 by the floating crane 42 and positioned on the rig 22 in the general arrangement indicated in FIG. 4. When the rig 20 is loaded with the requisite number of templates including a template 36 suspended from the derrick hoisting apparatus and also supported by suitable hanger apparatus, not shown, the rig can proceed to the offshore site for installation of the templates. Upon reaching the predetermined site for installation of the templates the rig 20 is anchored and deballasted in accordance with procedures known in the art, and dependent on sea conditions, preparatory to installation of the templates 36 and 38.

Figure 7:
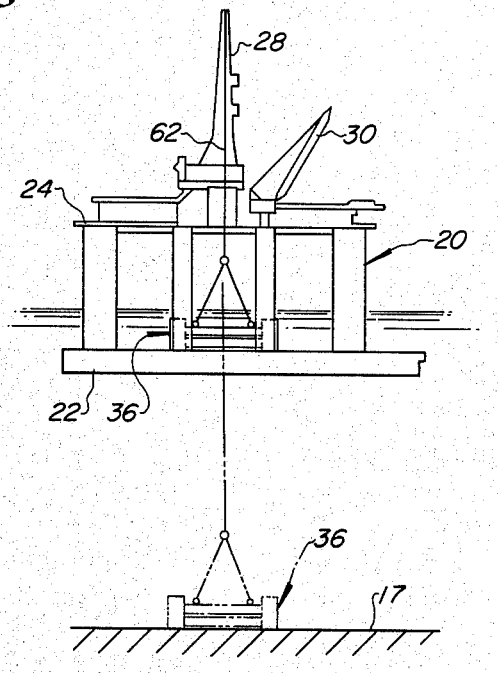
FIG. 7 is a side elevation showing a center loaded template being lowered into position on the seabed.

Upon reaching the predetermined site for installation of the template 36, for example, the aforementioned template hanger mechanism is disconnected from the template and the template is lowered to a predetermined site on the seabed 17, as shown in FIG. 7.

Figure 8:
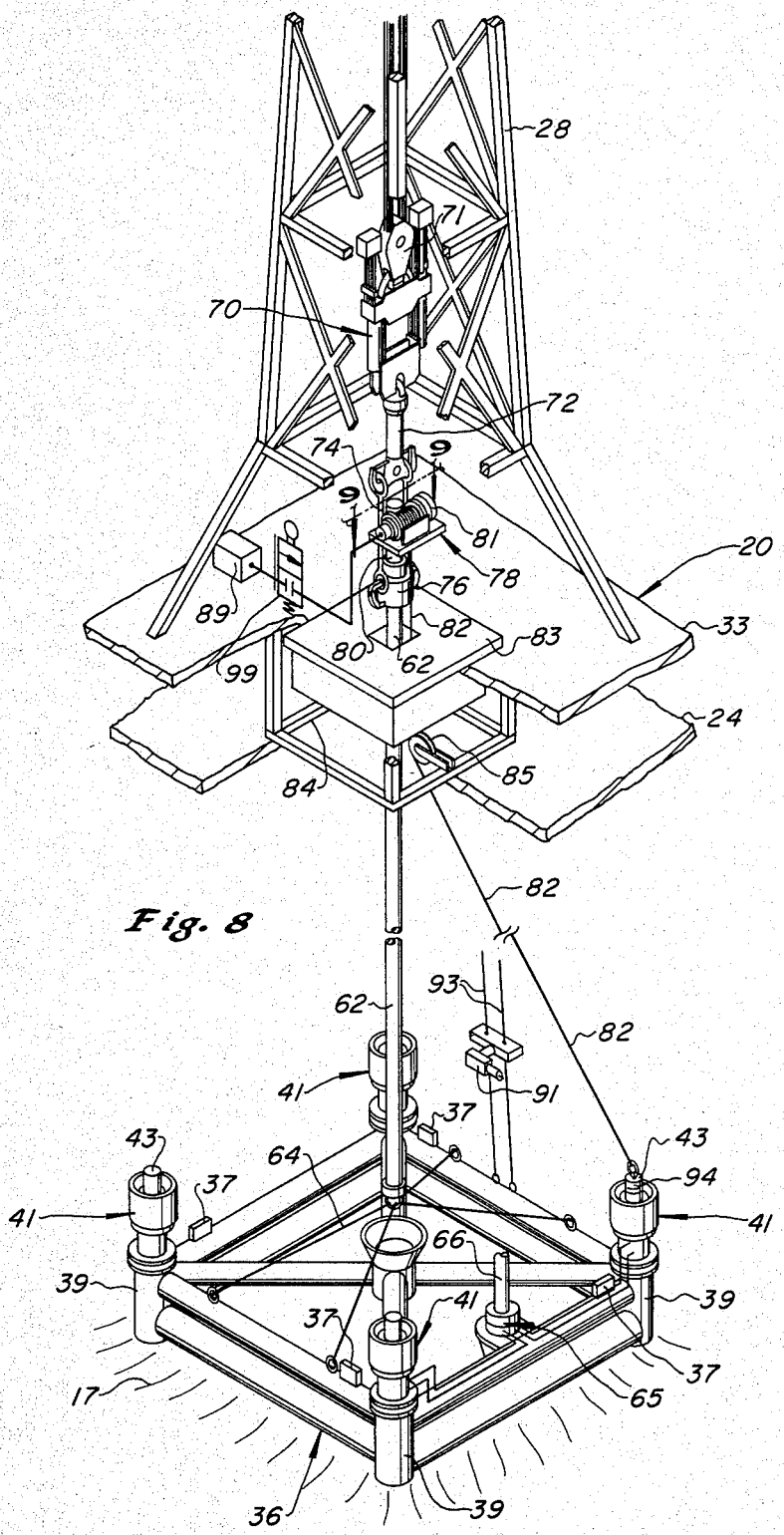
FIG. 8 is a perspective view of a portion of the drilling rig illustrating the levelling procedure.

Referring to FIG. 8 the template 36 is shown in position on the seabed 17 suspended from the derrick 28 by apparatus including an elongated riser string 62 and a flexible sling 64 connected to respective points on the template 36 equidistant from the riser string and such that the center of gravity of the template 36 is substantially coaxial with the longitudinal axis of and below the riser string 62. The template 36 is provided with suitable inclinometer or other level indicating units generally designated by the numeral 37 positioned on the corners of the templates 36 adjacent spaced apart vertical pile receiving sleeves 39. The template 36 is also provided with an improved slip assembly associated with each of the pile sleeves 39, generally designated by the numeral 41, for gripping respective elongated support columns or piles 43 which extend through the pile sleeves 39 and are driven and/or cemented into the seabed 17. The tempate 36 is also provided with a hydraulic control pod and receptacle arrangement of a type known in the art of subsea well apparatus and generally designated by the numeral 65 which is adapted to supply pressure fluid to each of the slip assemblies 41 by way of a hose bundle or umbilical 66 lowered from the rig 20.

The procedure of lowering the template 36 into position, and inserting the piles 43 into the pile sleeves is described in copending application Ser. No. 292,014 which is incorporated herein by reference. The aforementioned application also describes a preferred method of positioning the template 36 prior to drilling and/or driving the piles 43. With the piles in position as shown in FIG. 8 and with the umbilical 66 run from the rig 20 to the template so that control of the slip assemblies 41 may be exercised from on board the rig 20, from a suitable submersible vessel, not shown, or by divers positioned to view the level condition of the template, the levelling procedure of the present invention can be carried out using improved apparatus in accordance with the present invention.

Referring further to FIG. 8 it will be noted that the drill rig 20 is provided with a drill stem heave or motion compensator, generally designated by the numeral 70. The heave compensator 70 is of a type which is commercially available and one type of compensator which will operate in conjunction with the apparatus and method of the present invention is a heave or motion compensator manufactured by NL Rig Equipment Division of NL Industries, Inc., Houston, Tex., under the trademark RUCKER. The heave compensator 70 is suspended from the derrick hoisting apparatus including a crown block, not shown, and a cable arrangement reeved through a travelling block 71 connected to the compensator. The motion compensator 70 includes a hook 72 from which spaced apart elevator links or bails 74 are suspended and are connected to a suitable riser elevator 76. The riser string 62 is suspended from the elevator 76 and the upper end of the riser string also supports a unique tensioner assembly generally designated by the numeral 78.

Figure 9:
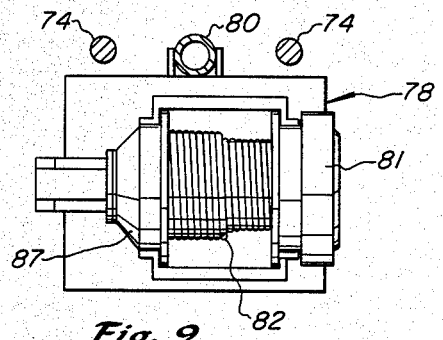
FIG. 9 is a plan view of the tensioning winch assembly taken from the line 9—9 of FIG. 8.

The tensioner assembly 78 comprises a generally rectangular frame 79, see FIG. 9, along one side of which is secured a short section of drill collar or sub 80. The frame 79 also supports a motor driven drum type winch or so called air tugger unit generally designated by the numeral 81. The winch 81 includes a winch drum on which an elongated tensioner cable 82 is wound and extends from the winch downward through a rotary table 83, supported on the rig platform 33 with its kelly bushing removed. The riser string 62 and the cable 82 extend downward through a moon pool 84 formed in the main deck 24 and the cable 82 is trained over a sheave 85 suitably connected to structure associated with the deck 24 in the vicinity of the moon pool. As illustrated in FIG. 8, the cable 82 extends downward from the rig 20 and is connected to one of the piles 43. The winch 81 is of a type having a pressure fluid operated motor 87 which is operable to exert a substantially constant torque on the winch drum to maintain a constant predetermined tension in the cable 82. The winch motor 87 is adapted to be connected to a source of pressure air such as a compressor 89 by way of a suitable flow control valve 99 indicated schematically in FIG. 8. The tensioner assembly 78 is adapted to be supported by the riser string 62 by suitably coupling the sub 80 to the upper end of the riser string. Accordingly, the tensioner assembly 78 is adapted to move with the riser string 62 relative to the rig 20 in response to movement of the heave compensator 70 to compensate for motion of the rig under certain sea conditions.

The improved levelling procedure previously mentioned is carried out after the piles 43 have been inserted in the pile sleeves 39 and the rig 20 is suitably positioned substantially over the center of the template 36 and the rig mooring system is normalized. With the rig 20 properly positioned the riser string 62 is run to a point above the template 36 and the sling assembly 64 is connected to the template. The sling assembly 64 may be connected to the template by submarine divers dispatched from the rig 20 or a suitable surface or submarine support vessel. The riser string 62 is disconnected from the heave compensator 70 assuring that there is enough slack in the lifting slings 64 and set on a spider or slip assembly, not shown, suitably supported by the rotary table 83.

At this point, an underwater television camera 91 can be run from the rig 20 on suitable guidelines 93 and focused on one of the piles 43 which is provided with suitable indicia such as spaced apart bench marks 94 so that movement of the template relative to the pile can be observed. The inclinometer units 37 can also be viewed by a television camera or the units may be of a type which are capable of transmitting signals directly to a suitable receiver on the rig 20, for example, to indicate the level condition of the template 36.

While divers are positioning the television camera 91 and/or the sling assembly 64 the tensioner assembly 78 can be suitably connected to the riser string with the sub 80. The heave compensator 70 is then lowered to permit connection of the links 74 to the hook 72 and the tensioner assembly 78 together with the riser string 62 is picked up by the rig hoisting apparatus 34. With the riser string 62 and the tensioner assembly 78 attached to the hook 72 the rig hoisting apparatus is raised until there is approximately, for example, eight feet of slack in the sling assembly 64. At this time, the tensioner line 82 may be lowered through the rotary table 83 to the moon pool, trained over the sheave 85 and run to the template 36 using, for example, a guideline, not shown, for the hydraulic control pod 65. The tensioner line 82 is then connected to one of the piles 43, as illustrated in FIG. 8, and pressure air supplied to the hoist motor 87 at a pressure sufficient to support the weight of the tensioner line 82.

At this point, if the control pod 65 is not already connected for supplying pressure fluid to the slip assemblies 41 this procedure is carried out in accordance with known techniques for connecting subsea hydraulic connector assemblies such as the control pod 65 to mating pod receptacles. The template 36 is now ready for the final levelling process which comprises pressurizing the hydraulic system of the heave compensator 70 to position the compensator at about mid length its working stroke at which point it will normally take up the weight of the template 36. The compensator 70 is then additionally pressurized until the template 36 is in a level plane as indicated by the inclinometer units 37. The television camera 91 is then focused on the reference pile including the aforementioned indicia or bench marks 94 and movement of the template 36 relative to the pile is observed. The pressure air supply to the winch motor 87 is increased to increase the tension in the line 82 while observing the dampening effect on the relative movement between the template 36 and the aforementioned reference pile. Tension in the line 82 is adjusted until there is no relative movement between the template and the reference pile whereupon the template is level and motionless.

At this point the signals from the inclinometer units 37 are rechecked to ensure that the template is level within the allowable tolerance. If the template is level within tolerance the slip assemblies 41 are activated to grip the piles 43 to secure the template 36 to the piles. After activation of the slip assemblies 41 the rig hoisting apparatus is slacked off to allow the weight of the template to be transferred on to the piles to set the slip assemblies and the inclinometer readings are rechecked to determine if the template is still level within tolerance. If the template level is not within tolerance the rig hoisting apparatus is operated to pick up on the travelling block and the heave compensator 70 to take the weight of the template. The slips 41 are then activated to retract and the above described procedure is carried out until the template is level and locked. At this time, the hydraulic control pod 65 can be retrieved and divers can be jumped to disconnect the sling assembly 64 and the tensioning line 82. The tensioning line 82 may be reshackled to the aforementioned guidelines for the control pod 65 and retrieved to the moon pool then removed from the guideline and pulled back through the rotary table 83 by rotating the drum of the winch assembly 81. The riser string 62 and slings 64 may then be retrieved in a conventional manner.

Figure 12:
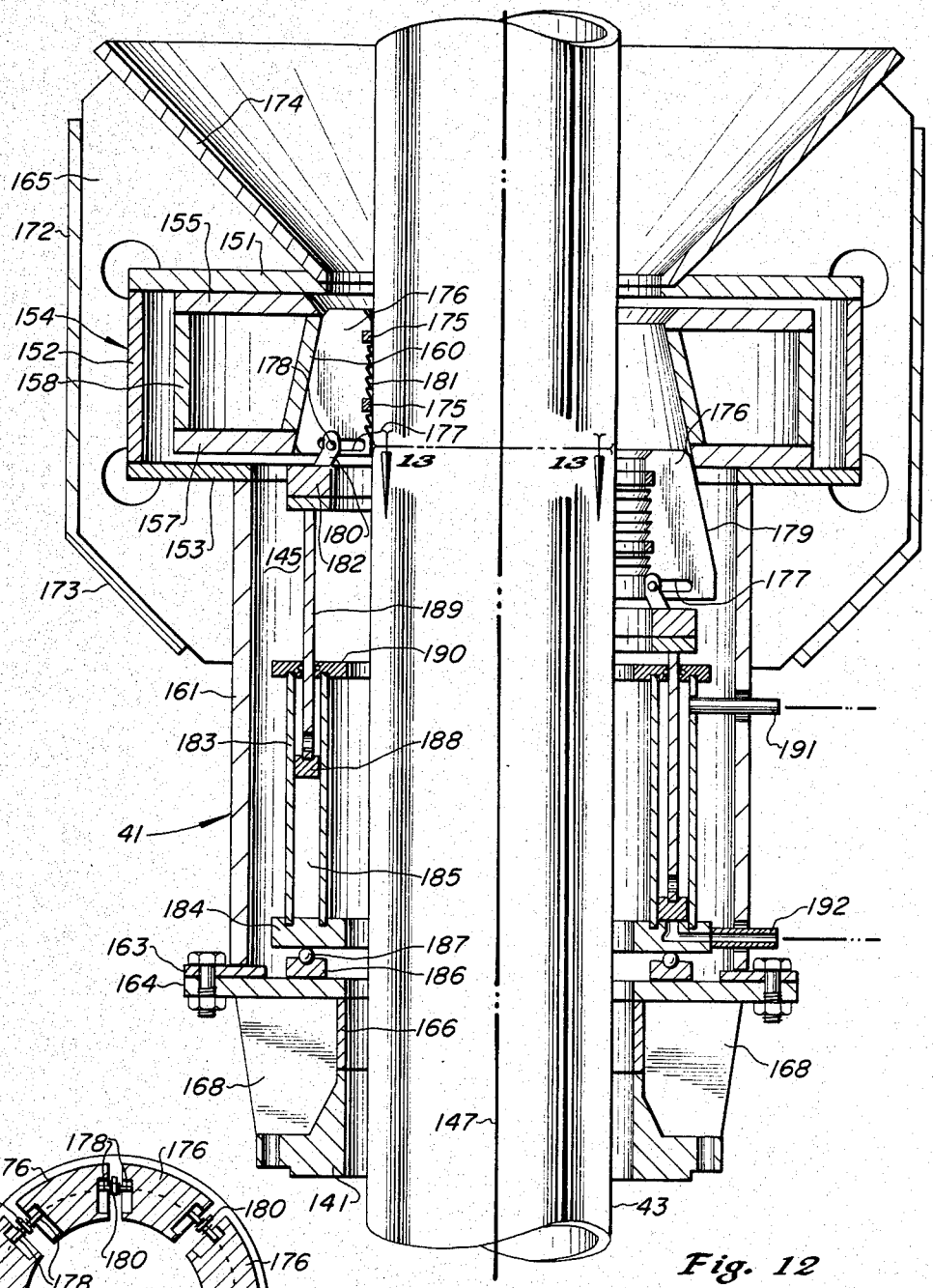
FIG. 12 is a central section view of a pile slip assembly used in conjunction with the template levelling procedure of the present invention.
Figure 13:
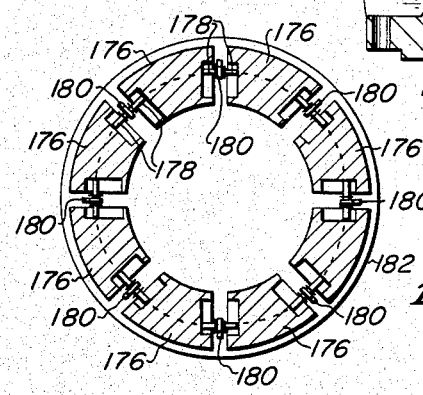
FIG. 13 is a section view taken along the line 13—13 of FIG. 12.

Referring briefly to FIGS. 12 and 13 one of the slip assemblies 41 is illustrated in longitudinal central section view and wherein the figure illustrates to the left of the longitudinal centerline the slip assembly in its actuated position and to the right in its retracted position. The slip assembly 41 is described and claimed in a copending application filed concurrently herewith. However, certain features of the slip assembly will be described hereinbelow to facilitate a better understanding of the operation of the slip assembly.

The slip assembly 41 is adapted to surround a pile 43 and to grippingly engage the pile as will be evident from the following description. The slip assembly 41 includes a frame comprising upper and lower ring shaped abutment plates 151 and 153, respectively, which are secured to and spaced apart by a cylindrical tubular wall member 152. An annular slip bowl 154 is disposed within the enclosure formed by the frame plates 151 and 153 and includes upper and lower plates 155 and 157 which are spaced apart by an outer cylindrical wall 158 and a conically tapered inner wall 160. The slip bowl 154 fits loosely between the plates 151 and 53 and is operable to center itself radially with respect to the longitudinal central axis 147 of the slip assembly. The slip bowl 154 is also operable to move axially and to tilt with respect to the central axis of the slip assembly within the limits imposed by the frame plates 151 and 153 to accommodate some skew misalignment of the pile with respect to the slip assembly.

The lower plate 153 is supported by a cylindrical tubular frame member 161 which is secured to a mounting ring 163 and defines a receptacle 145 in which the pile 43 is disposed together with an actuator for the slip assembly to be described herein. The mounting ring 163 is supported by and secured to a base plate 164. The base plate 164 is supported on and secured to a sleeve 166 and a mounting flange 141 by a plurality of radially extending gusset plates 168. The slip assembly 41 is also provided with a cylindrical outer housing member 172 disposed around the frame portion formed by the plates 151 and 153 and fixed thereto by a plurality of radially projecting gusset plates 165. The gussets 165 are also secured to lower and upper conical plates 173 and 174, disposed below and above the housing member 172, as shown. The conical plate 174 forms a guide funnel for guiding a pile into the central receptacle in the frame of the slip assembly.

The slip assembly 41 is also provided with a plurality of slip segments 176 which are disposed generally within the tapered slip bowl wall 160 in surrounding relationship to a pile. The segments 176 are preferably formed of case hardened steel and are arranged to engage a pile as shown by the position of one of the slip segments on the left side of the central axis of the slip assembly in FIG. 12. The slip segments 176 are each in the form of a circular segment or sector portion, are preferably provided eight in number and are interconnected and biased outwardly against the wall 160 by suitable annular resilient retaining springs 175 fitted in cooperating grooves in the inner wall surfaces of the slip segments. The springs 175 may be formed as a resilient steel split ring, for example, not unlike a piston ring and operable to bias the slip segments radially outward with respect to the axis 147 against the inner wall 160 of slip bowl. The segments 176 include a sloping outer wall 179 and a cylindrical inner wall 181, the latter being provided with a series of gripping teeth or serrations for gripping the outer surface of a pile. The segments 176 are also provided with slots 177 formed in the opposed sidewalls of the segments. The slots 177 are adapted to receive oppositely projecting trunnions 178 which are attached to spaced apart brackets 180 mounted on a circular guide ring 182.

The slip assembly 41 further includes hydraulic actuator means comprising an annular hydraulic cylinder 183 having a lower head member 184 which is supported on an anti-friction ball bearing assembly including a ball housing 186 supported on the base plate 164 and adapted to include bearing elements 187. The cylinder 183 is adapted to form a chamber 185 having an annular piston 188 disposed therein and connected to a piston rod portion 189 which is vertically extendable and retractable with respect to the cylinder through an upper head member 190 and is in supportive relationship with the guide ring 182. Pressure fluid is supplied to cylinder 182 to act on opposed faces of the piston 188 through suitable conduits 191 and 192, which are connected to the receptacle of control pod 65.

In response to application of pressure fluid into the portion of annular cylinder chamber 185 formed below the piston 188, the guide ring 182 is moved upwardly which in turn moves the slip segments 176 against the tapered inner wall 160 to force the segments radially inwardly into gripping engagement with the outer circumferential surface of the pile 122. Moreover, the weight of the template acting through the slip segments 176 tends to self energize the segments into tighter gripping engagement with the pile.

Figure 10:
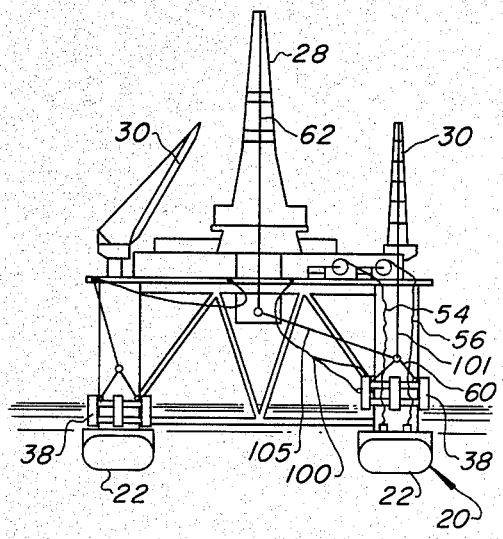
FIG. 10 is a side elevation showing one of the templates being unshipped from a hull of the semi-submersible drilling rig.
Figure 11:
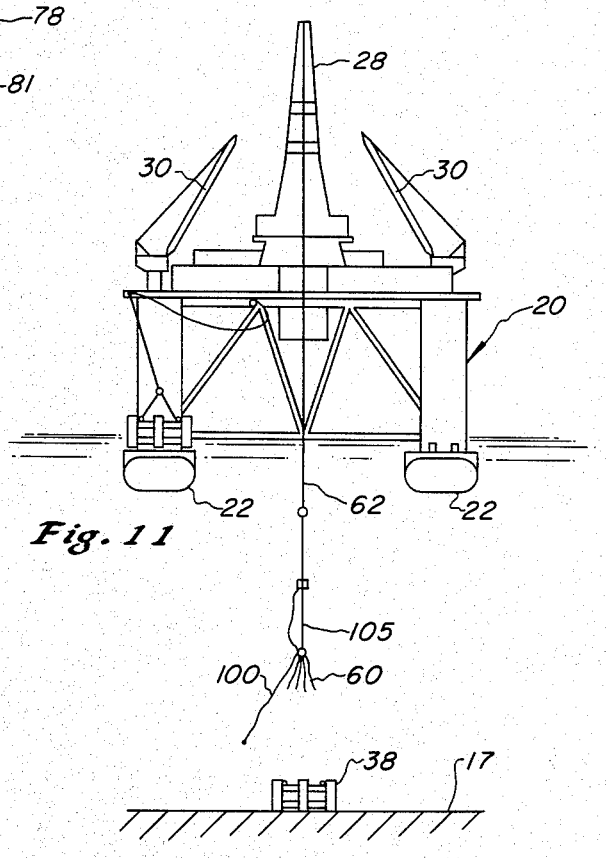
FIG. 11 shows the installation of the template unshipped in FIG. 10 at a predetermined site on the seabed.

The templates 38 may also be installed and levelled utilizing the procedure described above for installation and levelling of the template 36. However, the procedure for locating the templates 38 on the seabed is somewhat different due to their initial stowed position on respective ones of the hulls 22. After the rig 20 is located in a predetermined position for installation of one of the templates 38 the hulls 22 are controllably ballasted to be sure that the draft of the rig is sufficient to permit floating of the templates 38 after venting ballast from the respective ballast compartments and these templates. Referring to FIGS. 10 and 11, one of the templates 38 is shown with a ballast vent line 100 connected thereto for venting ballast from one or more of the aforementioned compartments and a snubbing line 101 is run from the starboard deck crane 30, for example, and is connected to the template 38 utilizing sling assembly 60 similar to the sling 64. The snub line 101 is trained through a suitable opening in the deck 24 and over a deck mounted sheave, not shown. A lifting line 105 is run to the sling 60 from the lower end of the riser string 62, which is suspended from the rig hoisting apparatus, and is pulled up into the area of the moon pool and suitably tensioned.

The template 38 is positioned under the moon pool by venting template ballast until the template floats free of the supporting and locating structure previously described and the lifting line 105 is taken up as the snub line 101 is slacked off until the template is in position under the moon pool. Additional transverse snub lines may be required depending on sea and current conditions. However, it is contemplated that it is possible to hold the template 38 in position by running a very tight lift assembly with five to ten foot seas and a slack tide condition. The guidelines 54 and 56 are adjusted during the template positioning procedure and disconnected and cleared from the template prior to lowering the template to the seabed. The template 38 is then lowered into a predetermined position on the seabed 17 generally using the same procedure as used for positioning the template 36. The templates 38 may be levelled in the same manner as described above for the template 36 and also utilizing level instrumentation disposed on each one of the templates 38 in generally the same manner as used for the template 36.

Alternatively, the templates 38 may be levelled screw jacks, not shown, and a drill string lowered from the hoisting apparatus of the rig 20 and the rotary table 83 and including a screw jack stinger assembly and bumper sub connected to the drill string with one drill collar connected to the string below the bumper sub. The riser string 62, lifting line 105 and sling 60 are first disconnected from the template 38 and derigged. The drill string may then be tripped down to the template on preinstalled guidelines, not shown, and an offset frame, also not shown. The levelling instrumentation is consulted to select the low point of the template and the drill collar is stabbed in and rotated until the template is levelled. The sequence is then repeated until the template is within 0.50 degrees of level, preferably. The drill string and screw jack stinger are then recovered and rigging for a pile driving hammer or other pile insertion procedures in commenced.

All of the templates 38 are installed using basically the same procedure with modifications as required depending on the position of the deck cranes 30 with respect to the location of the templates on the hulls 22.

Those skilled in the art will appreciate from the foregoing description that improved methods and apparatus have been developed for locating and levelling subsea structures such as drilling and foundation templates and other structures which must be held motionless in preferred attitude on the seabed and installed by a floating vessel such as a semi-submersible drilling rig or other vessel which is in a buoyant mode in or on the sea. Although preferred embodiments of the invention have been described in detail herein those skilled in the art will also recognize that various substitutions and modifications may be made to the methods and apparatus of the invention without departing from the scope and spirit of the invention as recited in the appended claims.

What I claim is:

1. A method of positioning a template or the like on the seabed comprising the steps of:

providing a floating vessel having a hoisting apparatus including a motion compensator suspended from said hoisting apparatus, and suspension means adapted to be connected to said motion compensator and to said template for lifting said template in response to operation of said hoisting apparatus;

providing means fixed to the seabed and adapted to be connected to said template for securing said template in a predetermined level position on the seabed;

providing adjustable tension means adapted to interconnect said suspension means and said means fixed to the seabed;

connecting said suspension means to said hoisting apparatus and said template;

interconnecting said tension means with said suspension means between said motion compensator and said template and with said means fixed to the seabed;

operating said hoisting apparatus to lift said template to level said template in a predetermined position while allowing said motion compensator to compensate for movement of said vessel with respect to said seabed, adjusting the tension in said tension means to dampen motion between said template and said means fixed to the seabed; and securing said template to said means fixed to said seabed.

2. The method set forth in claim 1 including the step of:

lowering said suspension means after securing said template to said means fixed to the seabed to transfer the weight of said template to said means fixed to the seabed.

3. The method set forth in claim 1 wherein:

said template comprises a plurality of spaced apart sleeve means for receiving, respectively, template supporting piles comprising said means fixed to the seabed, and said method includes the steps of inserting said piles in said sleeves, respectively, prior to lifting said template to level said template with respect to said piles;

observing the position of said template with respect to at least one of said piles to determine the dampening effect of said tension means; and adjusting the tension in said tension means until the observed motion of said template relative to said one pile is substantially nil prior to securing said template to said piles.

4. The method set forth in claim 3 wherein:

said template includes hydraulically actuated slip means associated with each of said sleeves for gripping respective ones of said piles disposed in said sleeves, and said method includes the step of actuating said slip means to grip said piles, respectively, followed by lowering of said suspension means to transfer the weight of said template to said piles through said slip means.

5. The method set forth in claim 1 wherein:

said suspension means includes a riser string suspended from said motion compensator;

said tension means includes a pressure fluid operated cable hoist having a cable drum and an elongated cable wound on said drum and having a free end, and said method includes the steps of:

suspending said hoist from said motion compensator and secured to said suspension means, connecting said free end of said cable to means fixed to the seabed, and operating said hoist by controlling the supply of pressure fluid to said hoist to apply a substantially constant tension to said cable.

6. The method set forth in claim 5 wherein:

said hoist comprises a frame including means for detachably securing said frame to said riser string, and said step of suspending said hoist comprises the step of securing said hoist to said riser string.

7. Apparatus for positioning and levelling a subsea template structure or the like on a seabed, said apparatus comprising:

a floating vessel including hoisting apparatus for raising and lowering suspension means including an elongated riser string, said hoisting apparatus including a motion compensator operable to maintain a substantially predetermined tension on said suspension means, said motion compensator including means for releasably connecting said motion compensator to said suspension means;

means at the lower end of said suspension means for lifting said template with respect to said seabed in such a way that said template will tend to assume a predetermined attitude with respect to said seabed;

tensioning means including a winch having a rotatable drum driven by a fluid motor and a single tension cable connected at one end to said drum and adapted to be connected at its other end to a point fixed with respect to said seabed, the tension on said cable being controlled by controlling the delivery of pressure fluid with respect to said motor; and to reduce movement of said template with respect to said seabed during said positioning of said template, and said winch includes a support frame including means for supporting said frame by said suspension means whereby said cable may be secured at said other end to means fixed to said seabed and at said one end to said suspension means.

8. The apparatus set forth in claim 7 wherein:

said support frame includes means for securing said support frame to said riser string.

9. The apparatus set forth in claim 7 wherein:

said suspension means includes means for lifting said template at a lift point substantially directly above the center of gravity of said template whereby said template will hang suspended from said suspension means in a substantially level condition.

10. A method of installing, levelling and securing a subsea template on a seabed comprising the steps of:

providing a floating vessel including hoisting apparatus for raising and lowering a template with respect to said seabed, said hoisting apparatus including a motion compensator and elongated suspension means extending from said motion compensator toward said seabed and adapted at a point on said suspension means to be connected to a template structure; and winch means supported by said hoisting apparatus between said motion compensator and said point on said suspension means, said winch means including cable means for connection at a free end of said cable means to means fixed to said seabed;

providing a template structure comprising a frame having a plurality of spaced apart pile receiving sleeves, formed thereon, said template structure including gripping means associated with said sleeves for releasably gripping piles disposed in respective ones of said sleeves for securing said template structure to said piles;

positioning said template structure with said vessel over a predetermined point on said seabed and lowering said template structure to said seabed;

installing a selected number of piles in respective ones of said sleeves and extending adjacent to said gripping means, respectively;

lifting said template structure with said hoisting apparatus to level said template with respect to a predetermined reference level condition;

tightening said cable means with said winch means to damp motion of said suspension means and said template structure;

actuating said gripping means to connect said template to said piles, respectively; and lowering said template with said hoisting apparatus to transfer the weight of said template to said piles through said gripping means.

11. A method of positioning a template or the like on the seabed comprising the steps of:

providing a floating vessel having a hoisting apparatus including a motion compensator suspended from said hoisting apparatus, and suspension means connected at one end of said suspension means to said motion compensator and at the other end of said suspension means to said template for lifting said template in response to operation of said hoisting apparatus;

providing support means fixed to the seabed and adapted to be connected to said template for securing said template in a predetermined position on the seabed;

providing adjustable tension means including an elongated cable adapted to be interconnected between said hoisting apparatus and a point of connection fixed to the seabed;

connecting said suspension means to said hoisting apparatus and said template;

interconnecting said cable with said hoisting apparatus between said motion compensator and said template and with said point of connection fixed to the seabed;

operating said hoisting apparatus to position said template in a predetermined position while allowing said motion compensator to compensate for movement of said vessel with respect to said seabed, adjusting the tension in said cable to damp motion between said template and said support means; and securing said template to said support means.

* * * * *